US008215209B2

(12) United States Patent
Hsu

(10) Patent No.: US 8,215,209 B2
(45) Date of Patent: Jul. 10, 2012

(54) SCREW DRIVING MEMBER

(75) Inventor: Ming-Hung Hsu, Taichung (TW)

(73) Assignee: Mobiltron Electronics, Co., Ltd., Taichung County (TW)

( * ) Notice: Subject to any disclaimer, the term of this patent is extended or adjusted under 35 U.S.C. 154(b) by 378 days.

(21) Appl. No.: 12/556,526

(22) Filed: Sep. 9, 2009

(65) Prior Publication Data

US 2011/0056340 A1 Mar. 10, 2011

(51) Int. Cl.
*B25F 1/00* (2006.01)
*B25B 23/08* (2006.01)

(52) U.S. Cl. ..... 81/437; 81/451

(58) Field of Classification Search ..... 81/437, 81/448, 451, 460, 176.15, 176.2, 124.5
See application file for complete search history.

(56) References Cited

U.S. PATENT DOCUMENTS 3,396,765 A * 8/1968 Ridenour ..... 81/437
3,452,373 A * 7/1969 Vosbikian et al. ..... 7/138
4,237,946 A * 12/1980 Leitner ..... 81/429
5,992,274 A * 11/1999 Lammers ..... 81/451
6,047,620 A * 4/2000 Kozak et al. ..... 81/441
6,345,436 B1 * 2/2002 Codrington ..... 29/720
6,364,318 B1 * 4/2002 Bedi et al. ..... 279/22
6,418,821 B1 * 7/2002 Yamakawa ..... 81/437
7,111,530 B2 * 9/2006 Huang ..... 81/438
7,387,054 B2 * 6/2008 Rajotte ..... 81/429
2001/0006014 A1 * 7/2001 Cowart et al. ..... 81/437
2005/0076751 A1 * 4/2005 Panasik et al. ..... 81/451
2009/0049961 A1 * 2/2009 Chen ..... 81/429

* cited by examiner

*Primary Examiner* — David B Thomas
(74) *Attorney, Agent, or Firm* — Apex Juris, pllc; Tracy M. Heims

(57) ABSTRACT

A screw driving member of the present invention is driven by a power tool to turn a nut with a polygonal head and a slot on its top. The screw driving member includes a shaft, a driver head and a biasing device. The shaft has an axial hole and a fitting hole. The driver head is inserted into the axial hole of the shaft for reciprocation but rotation. The biasing device urges the driver head to have a coupling end out of the shaft. In engagement of the nut, the coupling end enters the slot of the nut, and then the driver head will be turned automatically that the coupling end may fully enter the slot. At the same time, the shaft is turned also that the fitting hole may be engaged with the head of the nut when the screw driving member is pressed downward.

5 Claims, 7 Drawing Sheets

SCREW DRIVING MEMBER

BACKGROUND OF THE INVENTION

1. Field of the Invention

The present invention relates generally to a driver for screws, and more particularly to a screw driving member capable of fast engaging screws with a polygonal head for turning.

2. Description of the Related Art

It is very common to turn a screw by a power tool. Usually the power tool is able to be replaced with various drivers and sockets to drive different kinds or sizes of screws. To improve efficiency, some power tools are equipped with a screw loading apparatus to load screws in sequence into the power tool that users may operate the power tool without having to repeatedly reload the screws.

When a screw is turned by a driver, the driver should be aligned with a center of the screw and engaged with a slot on a head thereof. Walls of the slot may be damaged when the driver is over turning the screw. Therefore, the force of the power tool on the screw should be limited.

When a screw is turned by a socket, such screw has a polygonal head (usually it is hexagonal) to be engaged with the socket. With this polygonal head there is a greater contact area between the head of the screw and the socket so that the power tool may provide greater power to turn the nut before it is damaged. The only drawback is that the socket needs to aim at a specific angle for engagement with the screw. Before the screw is engaged with a turning socket, the process of aiming for a right angle may already damage the corners of the head.

In conclusion, both driver and the socket have their advantages and disadvantages. The advantage of the driver is fast engagement, but its output power is poor; the advantage of the socket is with greater output power, however, inconvenient engagement and screw head's corner damage is its weak part.

SUMMARY OF THE INVENTION

The primary objective of the present invention is to provide a screw driving member capable of assisting fast engagement with a screw.

The secondary objective of the present invention is to provide a screw driving member applicable for both driver and socket that greater power may be exerted on the screw.

According to the objectives of the present invention, a screw driving member of the present invention is driven by a power tool to turn a nut with a polygonal head and a slot on a top of the head which includes a shaft having a coupling portion to be connected to the power tool and a driving portion having an axial hole and a fitting hole to be engaged with the polygonal head of the screw, wherein the axial hole and the fitting hole are coaxial; a driver head, which is engaged with the axial hole of the shaft for anti-rotation, having a coupling portion to be engaged with the slot on the polygonal head of the screw, wherein the driver head is moved between a first position, in which the coupling portion of the driver head is out of the axial hole of the shaft, and a second position, in which the coupling portion of the driver head is received in the axial hole of the shaft; and a biasing device received in the axial hole of the shaft to urge the driver head toward the first position.

DETAILED DESCRIPTION OF THE INVENTION

The screw driving member of the present invention is incorporated in a power tool equipped with an automatic screw loading apparatus. The power tool and the screw loading apparatus are conventional devices, so we don't describe their details here. Besides, the screw driving member of the present invention is particularly used in turning the screws and making them applicable for both driver and socket. Such screw has a polygonal head, on a top of which a slot is provided. In the following description, a screw 1 has a hexagonal head 1*a* and a cross slot 1*b* on a top of the hexagonal head 1*a*.

Figure 1:
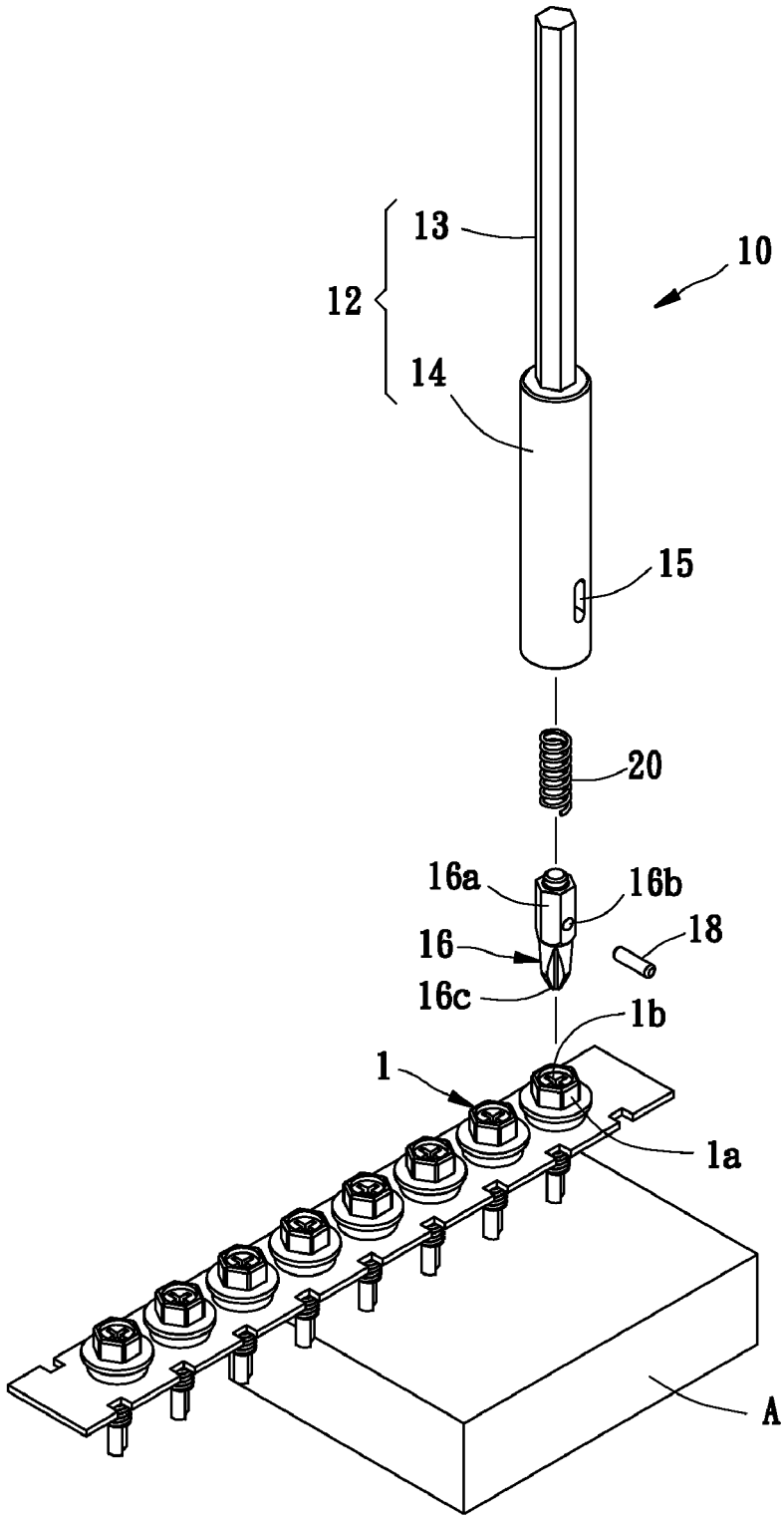
FIG. 1 is an exploded view of a first preferred embodiment of the present invention.
Figure 2:
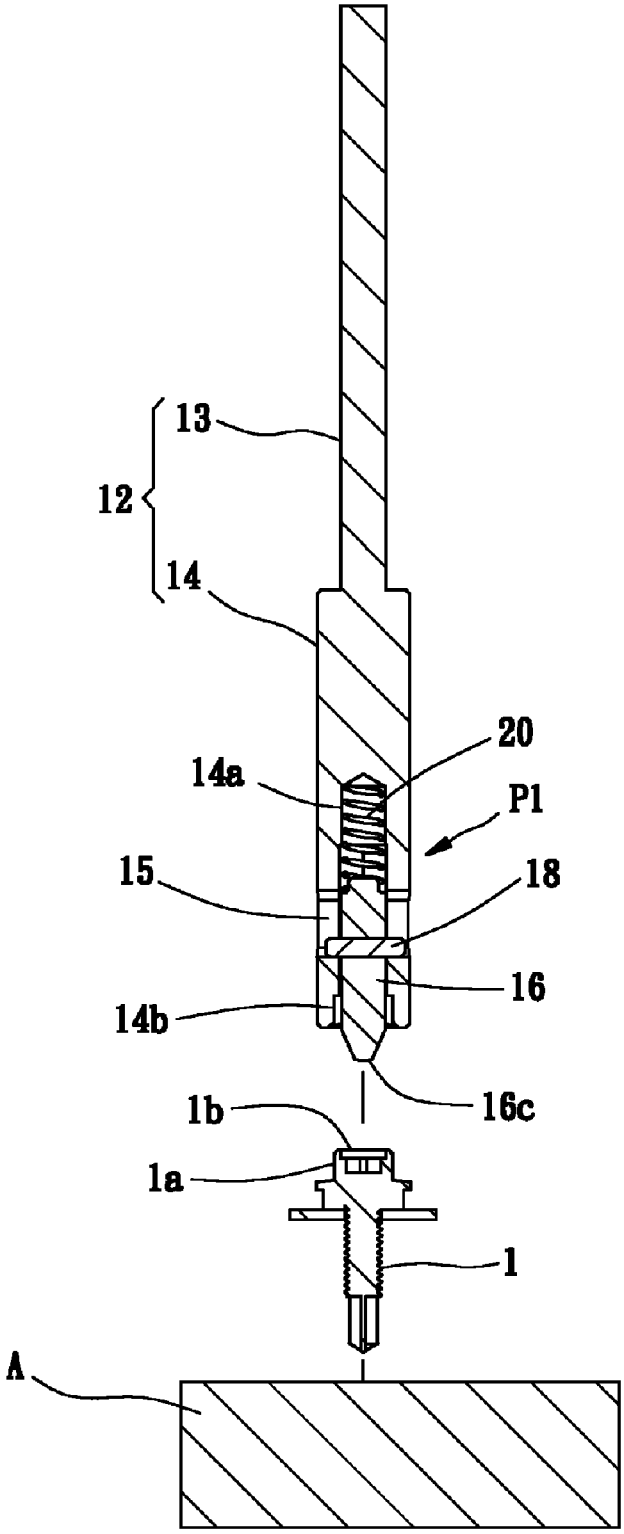
FIG. 2 is a sectional view of FIG. 1.

As shown in FIG. 1 and FIG. 2, the screw driving member 10 of the first preferred embodiment of the present invention includes a shaft 12, a driver head 16, and a biasing device, which is a spring 20 in the present embodiment.

The shaft 12 has a straight section divided into a coupling portion 13 and a driving portion 14. The coupling portion 13 may connect the shaft 12 to a power tool (not shown). The driving portion 14 is a barrel with an axial hole 14*a* and a fitting hole 14*b* therein. The axial hole 14*a* and the fitting hole 14*b* are coaxial and hexagonal. The fitting hole 14*b* is open at an end of the shaft 12 and is bigger than the axial hole 14*a*. The driving portion 12 is provided with two guiding slots 15 at opposite sides communicated with the axial hole 14*a*.

The driver head 16 has a hexagonal body 16*a* to be inserted into the axial hole 14*a* of the shaft 12 that the driver head 16 may not rotate relative to the shaft 12. The driver head further has a transverse hole 16*b* aligned with the guiding slots 15 of the shaft that a pin 18 may be inserted through the guiding slots 15 and the hole 16*b* to allow the driver head 16 only moving along an axial direction between a first position P1 (shown in FIG. 2) and a second position P2 (shown in FIG. 6). The driver head 16 has a cross coupling end 16*c* to be engaged with the cross slot 1*b* of the screw 1. The coupling end 16*c* is exposed out of the shaft 12 when the driver head 16 is moved to the first position P1, and is received in the shaft 12 when the driver head 16 is moved to the second position P2.

The spring 20 is received in the axial hole 14*a* of the shaft 12 to urge the driver head 16 toward the first position P1.

The elements and structure of the driving member 10 of the present invention are described as above, and we'll continue with the operation and function in following description.

Figure 3:
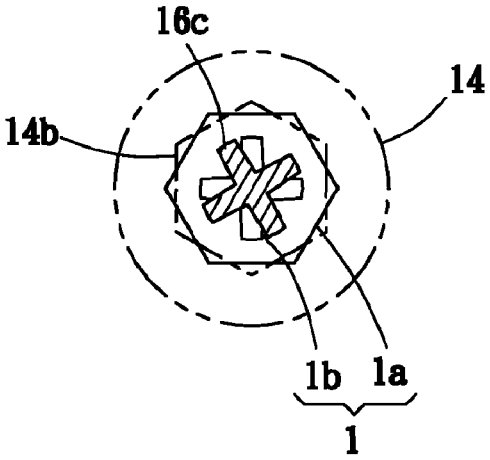
FIG. 3 is a sketch diagram, showing the cross-head driver not aligned with the cross slot of the screw.
Figure 4:
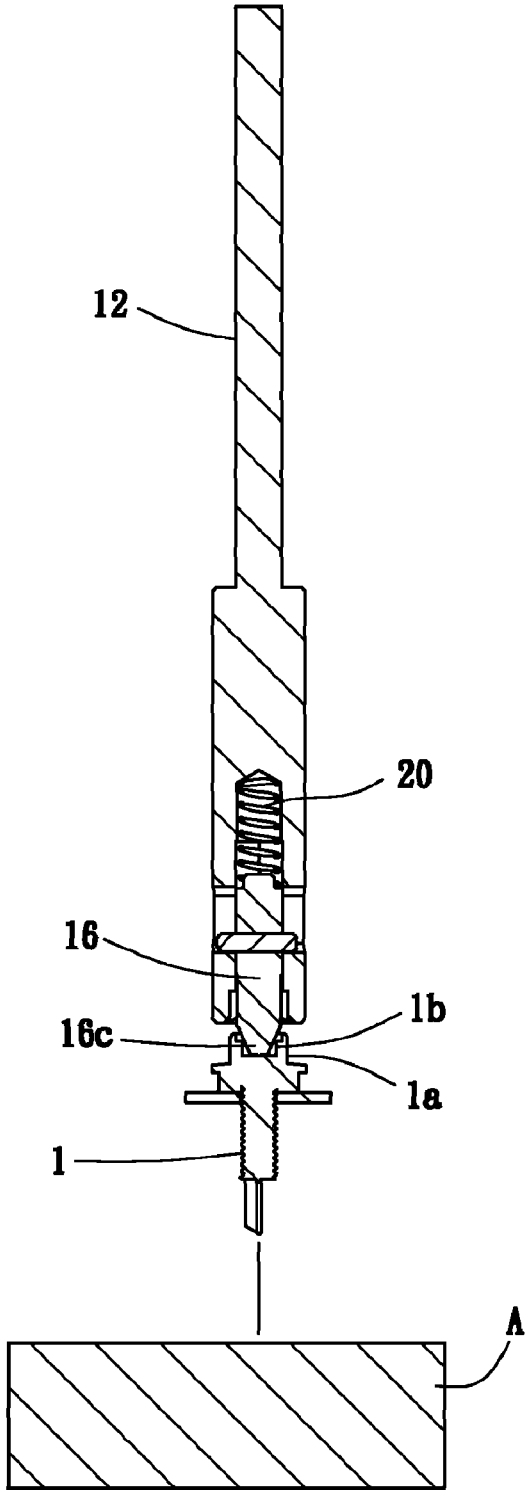
FIG. 4 is similar to FIG. 2, showing the driver engaged with the screw.

As shown in FIG. 3, when user moves the driving member 10 toward the screw 1 and the coupling end 16*c* of the driver head 16 is not aligned with the cross slot 1*b* of the screw 1, a tip of the coupling end 16*c* will enter a center of the cross slot 16*c* first, and then the driver head 16 will be turned automatically by walls of the cross slot 16*c* that the coupling end 16*c* may fully engage the cross slot 16*c* of the screw 1, as shown in FIG. 4.

Figure 5:
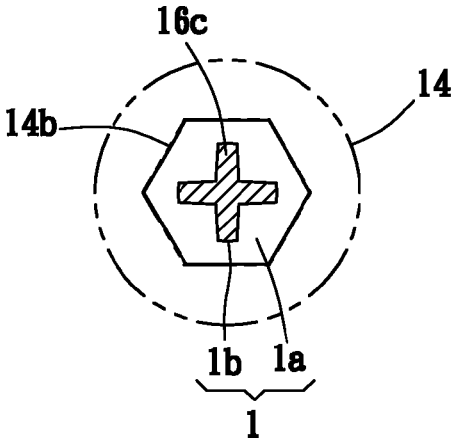
FIG. 5 is similar to FIG. 3, showing the cross-head driver aligned with the cross slot of the screw.
Figure 6:
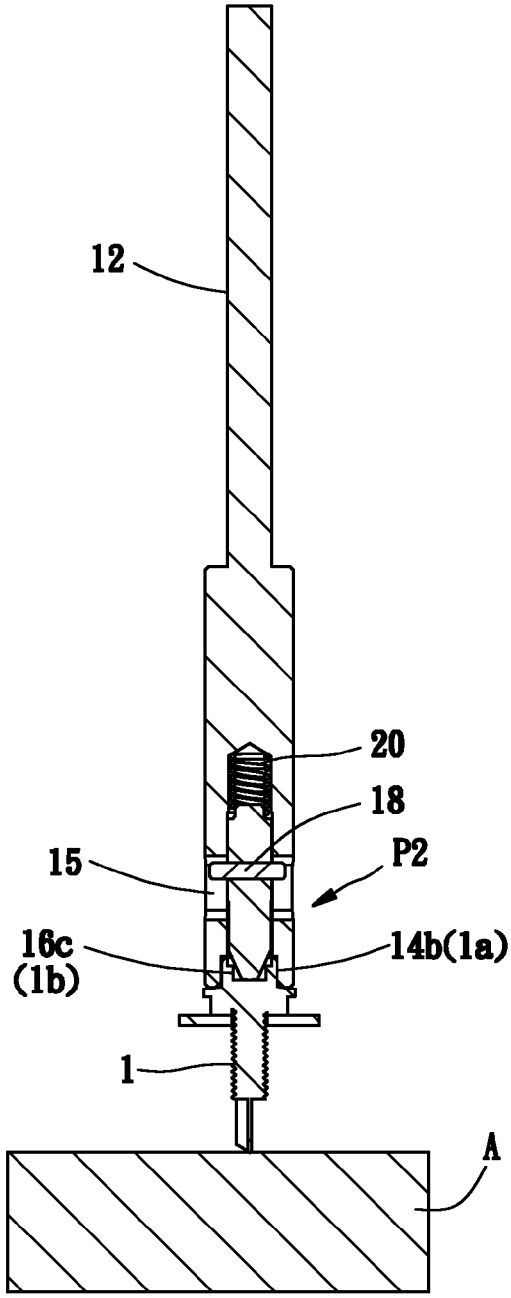
FIG. 6 follows FIG. 4, showing the fitting hole of the shaft fitted to the hexagonal head of the screw.
Figure 7:
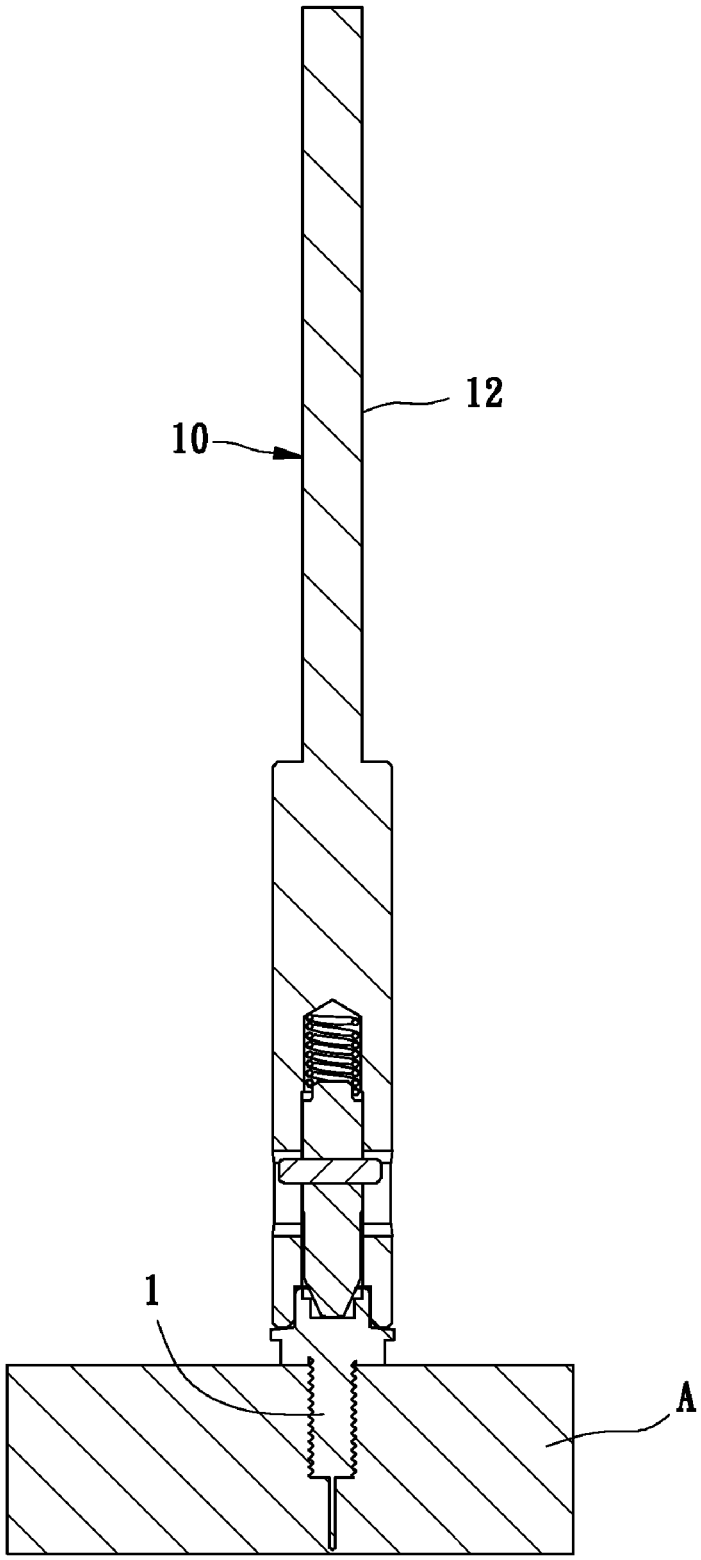
FIG. 7 follows FIG. 6, showing the screw being turned.

An emphasis of the present invention is on that, the driver head 16 will turn the shaft 12 along the same direction also when the driver head 16 turns the screw 1. In other words, when the coupling end 16*c* of the driver head 16 is fully engaged with the cross slot 1*b* of the screw 1, the hexagonal fitting hole 14*b* of the shaft 12 will be turned to a position which prepares it for engaging the hexagonal head 1*a* of the screw 1, as shown in FIG. 5, so that the fitting hole 14*b* of the shaft 12 is able to engage the head 1*a* of the screw 1 when one presses the screw driving member 10 downward, as shown in FIG. 6, to drive the screw 1 into an object A by operating the power tool, as shown in FIG. 7. In conclusion, the screw driving member 10 of the present invention is capable of giving an automatic and fast engagement with an insertion of the tip of the coupling end 16*c* into the center of the cross slot 1*b* and an engagement of the fitting hole 14*b* and the hexagonal head 1*a* that may provide the screw 1 with greater power to screw into the object A.

Figure 8:
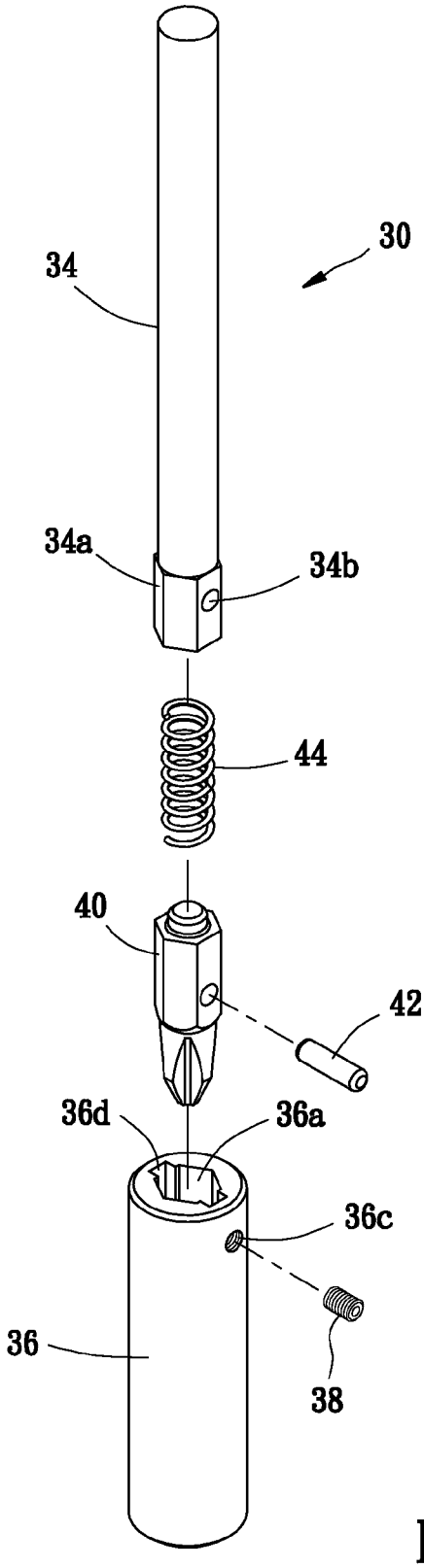
FIG. 8 is an exploded view of a second preferred embodiment of the present invention.
Figure 9:
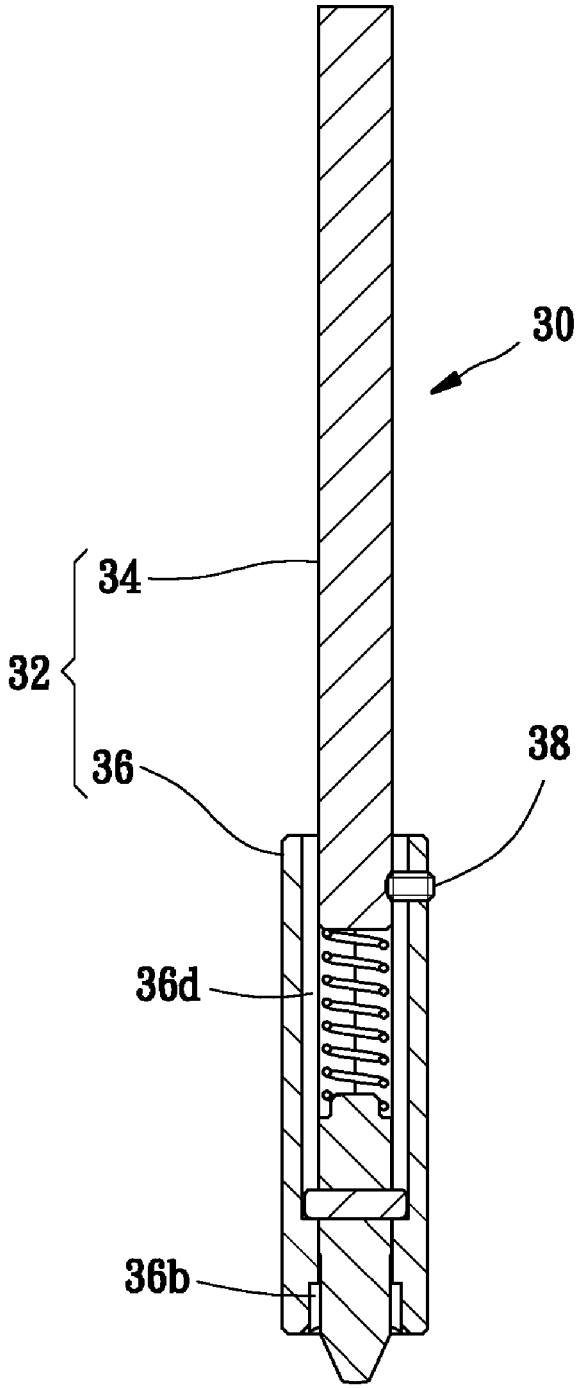
FIG. 9 is a perspective view of the second preferred embodiment of the present invention.

FIG. 8 and FIG. 9 show a screw driving member 30 of the second preferred embodiment of the present invention, which is similar to the first preferred embodiment, except that:

A shaft 32 has a post 34 to be the coupling portion and a socket 36, which is open at both ends, to be the driving portion. The post 34 has an end coupled with a power tool (not shown) and a noncyclic section 34*a* (it is shown as hexagonal in drawing) at an opposite end. The hexagonal section 34*a* is provided with a recess 34*b*. A socket 36 has an axial hole 36*a* and a fitting hole 36*b* which are hexagonal also. The socket 36 further has a through threaded hole 36*c*. A stop bolt 38 may be screwed into the threaded hole 36*c* and has an end against the recess 34*b* of the post 34 to prevent the post 34 and the socket 36 from separation.

A pin 42 is inserted through a driver head 40 also. However, both ends of the pin 42 are received in two guiding slots 36*d* on a sidewall of the axial hole 36*a* of the socket 36. A spring 44 has one end urging the hexagonal section 34*a* and an opposite end urging a rear end of the driver head 40.

The main difference between the screw driving member 10 of the first preferred embodiment and the screw driving member 30 of the second preferred embodiment is that, one of which has a single-section shaft and the other of which has a multi-section shaft. However, they may achieve the functions of fast engagement and providing greater power.

The description above is a few preferred embodiments of the present invention and the equivalence of the present invention is still in the scope of the claim of the present invention.

What is claimed is:

1. A screw driving member, which is driven by a power tool to turn a nut with a polygonal head and a slot on a top of the head, comprising:

a shaft having a coupling portion to be connected to the power tool and a driving portion having an axial hole and a fitting hole to be engaged with the polygonal head of the screw, wherein the axial hole and the fitting hole are coaxial;

a driver head, which is engaged with the axial hole of the shaft for anti-rotation, having a coupling portion to be engaged with the slot on the polygonal head of the screw, wherein the driver head is moved between a first position, in which the coupling portion of the driver head is out of the axial hole of the shaft, and a second position, in which the coupling portion of the driver head is received in the axial hole of the shaft;

a biasing device received in the axial hole of the shaft to urge the driver head toward the first position; and further comprising a pin, wherein the shaft is provided with at least a guiding slot on the driving portion, and the pin is inserted through the driver head and enters the guiding slot.

2. The screw driving member as defined in claim 1, wherein the axial hole of the shaft is a noncyclic hole, and the driver head is complementary to the axial hole.

3. The screw driving member as defined in claim 1, wherein the shaft has two of the guiding slots at opposite sides communicated with the axial hole, and the pin has opposite ends received in the guiding slots respectively.

4. The screw driving member as defined in claim 1, wherein the guiding slot is provided on a sidewall of the axial hole, and the pin has an end received in the guiding slot.

5. The screw driving member as defined in claim 1, wherein the shaft has a post, a socket connected to the post, and a stop bolt, wherein the post has the coupling portion thereon and a noncyclic section at an end thereof, and the socket has a threaded hole, and the stop bolt is screwed into the threaded hole of the socket to touch the noncyclic section of the post, and the biasing device has opposite ends urging an end of the noncyclic section and a rear end of the driver head.

* * * * *